United States Patent [19]

Lott

[11] Patent Number: 4,638,285

[45] Date of Patent: Jan. 20, 1987

[54] SURGE SUPPRESSING RESISTOR FOR A DISCONNECT SWITCH

[75] Inventor: Donald L. Lott, Portland, Oreg.

[73] Assignee: Siemens Energy & Automation, Inc., Atlanta, Ga.

[21] Appl. No.: 706,715

[22] Filed: Feb. 28, 1985

[51] Int. Cl.[4] ..... H01C 7/10

[52] U.S. Cl. ..... 338/21; 338/234; 338/302; 361/117

[58] Field of Search ..... 338/21, 231, 234, 237, 338/302, 303, 321; 361/117, 126, 127, 128, 129, 130

[56] References Cited

U.S. PATENT DOCUMENTS

| | | | |
|---|---|---|---|
| 882,218 | 2/1903 | Thomas | 338/21 X |
| 3,447,118 | 5/1969 | Ferree | 338/21 |
| 3,869,691 | 3/1975 | Stunkard | 338/231 |
| 4,362,017 | 12/1982 | Weniger et al. | 338/21 |

FOREIGN PATENT DOCUMENTS

| | | | |
|---|---|---|---|
| 594413 | 8/1958 | Italy | 338/302 |

OTHER PUBLICATIONS

38th Annual American Power Conference 1976 Papers by A. D. Crino, K. B. Stump and D. L. Lott, Surge-Suppressing Resistors Applied to 345 and 500 kv Disconnect Switches.

Siemens-Allis Publication DC 10.1 May 1979, Surge Suppressing Resistors.

*Primary Examiner*—E. A. Goldberg
*Assistant Examiner*—M. M. Lateef
*Attorney, Agent, or Firm*—F. W. Powers; J. L. James

[57] ABSTRACT

A surge suppressing resistor for a disconnect switch is provided which has its interior and exterior surfaces in fluid communication with the atmosphere to achieve a greater cooling effect. A glass epoxy stacking rod is supported between the end flanges of the resistor assembly and is used when two or more resistor bodies are to be joined together to form a unitary resistor assembly. The stacking rod is stressed and compressive forces hold the resistor bodies together as a unit for structural rigidity and electrical contact.

2 Claims, 2 Drawing Figures

SURGE SUPPRESSING RESISTOR FOR A DISCONNECT SWITCH

This invention relates to power switching equipment and, more particularly, to a surge suppressing resistor for a disconnect switch.

Disconnect switches are frequently used to switch transformer magnetizing current, low level line or cable charging current, and parallel load currents. Successful interruption of a live circuit with a disconnect switch depends on establishing sufficient air gap dielectric strength which is a function of the amplitude of the current interrupted and the magnitude of the recovery voltage. Prior to achieving dielectric recovery after switching an alternating current, a momentary current interruption will occur each time the current passes through zero. Each such interruption will be followed by either a reignition or a restrike of the switching arc when recovery voltage reaches the necessary value. This phenomenon leads to transient over voltages called switching surge voltages, because of the abrupt changes occurring in the energy storage elements of the circuit. Energy stored in the inductive and capacitive elements must be dissipated in the circuit resistive elements.

The thermal design of a surge resistor reflects considerating for the intense heat generated in the short time of a single switch operation and takes advantage of the relatively infrequent operation required. In prior surge resistors, the procelain exterior of the surge resistor would transfer heat to the air relatively slowly. It was discovered that high silicon sand content resin epoxy, which has a good thermal conductivity, could be used in contact with the resistive element itself to absorb heat away from it very quickly and to store the heat until it could be dissipated. The heat was primarily dissipated through the end cap structure of the surge resistor. Obviously, this construction severely limited the frequency of operation with which a surge resistor could be used. Accordingly, it can be appreciated that it would be highly desirable to provide a surge resistor which dissipates heat more rapidly and which dissipates heat through other parts of the structure in addition to the end cap structure.

Heretofore, a typical surge resistor would consist of a 500 ohm nichrome resistor element would on an epoxy core mandrel and silver brazed to bronze end inserts. This assembly was encapsulated in the same epoxy, then put in a porcelain housing for environmental protection. The top end cap was sealed to the mounting flange and the bottom cap was relieved to permit breathing action. This construction provided a totally encapsulated resistor which permitted recoring. A typical 500 KV vertical break disconnect switch normally is equipped with four resistor modules per pole. Each 500 ohm module is rated as being capable of handling 42,000 watt seconds at 5-minute intervals. Similarly, on 345 KV circuits, three resistor modules, a total of 1500 ohms, are normally used. Accordingly, it would be appreciated that it would be highly desirable to provide a surge resistor which is capable of handling more energy at more frequent intervals and which has the structural integrity to withstand the forces involved and the atmosphere.

It is an object of this invention to provide a surge resistor which dissipates heat through its endcaps and through the resistor body as well.

Another objective of the present invention is to provide a resistor in which the interior of the resistor body is exposed to the atmosphere to assist in cooling.

Still another object of the present invention is to provide an integral structure wherein two or more resistor bodies are connected together forming a unitary structure wherein opposite ends of the structure are electrically connected.

Yet another object of the present invention is to provide a unitary structure wherein two or more resistor bodies are positioned about a connecting rod which holds the flanges and resistor bodies together in the structure while maintaining the resistor bodies in compression and in electric contact with each other.

SUMMARY OF THE INVENTION

Briefly stated, in accordance with one aspect of the invention, the foregoing objects are achieved by providing a hollow, thermally conductive, electrically resistive body having an exterior surface to transfer heat from said body and means for connecting the body in an electric circuit for conducting current through the electrically resistive body.

In accordance with another aspect of the invention, the foregoing objects are achieved by providing a surge resistor which comprises at least first and second hollow, thermally conductive, electrically resistive bodies, each having interior and exterior surfaces for transferring heat from the body. The bodies are aligned along a common longitudinal axis with a center flange positioned between the first and second resistor bodies and with a flange on each of the other ends of the resistor bodies. An electrically insulative stacking rod is positioned along the longitudinal axis inside the resistor bodies and extends between the first and second end flanges and is releasably connected to the flanges. This forms a unitary structure wherein the end flanges, center flanges and resistor bodies are electrically connected.

Heat generated during operation is dissipated through the flanges and directly to the atmosphere as well. The connecting rod and the end flanges provide mechanical strength. This provides a mechanically and electrically sound resistor which is open to the atmosphere for maximum cooling effect.

BRIEF DESCRIPTION OF THE DRAWINGS

While the specification concludes with claims particularly pointing out and distinctly claiming the subject matter which is regarded as the invention, it is believed that the invention would be better understood from the following description of the preferred embodiment taken in conjunction with the accompanying drawings in which:

DESCRIPTION OF A PREFERRED EMBODIMENT

Figure 1:
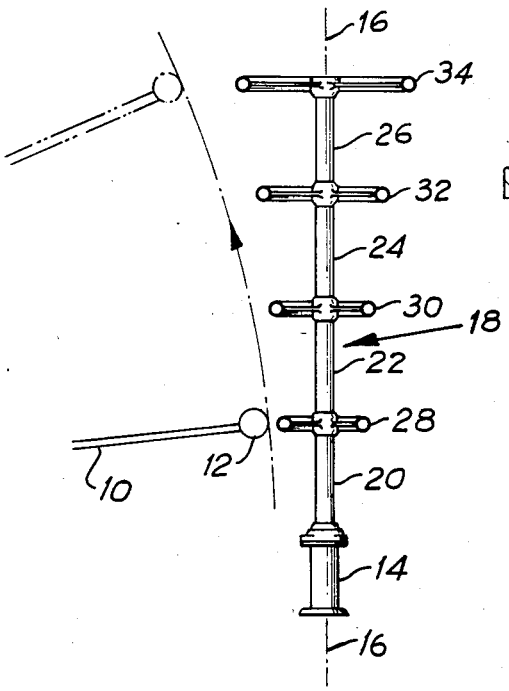
FIG. 1 illustrates in diagrammatic form a disconnect switch utilizing a surge resistor which has several resistor bodies joined together forming a unitary structure.

Referring to FIG. 1, a disconnect switch blade 10 is shown which has a corona ball 12 disposed on the end of the blade. In service, the disconnect switch blade mates with a contact (not shown) which is located in the vicinity of the resistor mounting adapter 14 which completes the desired circuit. When it is desired to break circuit, the disconnect switch blade 10 and the corona ball are rotated in the direction of the dotted arrow, which in this orientation is in a vertical arcuate direction with respect to the vertical axis 16 of the mounting adapter 14 and the surge resistor assembly 18 which is mounted on the adapter 14. In the embodiment shown, the resistor assembly 18 contains four resistor modules 20, 22, 24 and 26. There is a corona ring 28, 30, 32, 34 associated with a respective resistor module.

Operation of the vertical break switch is simple and for the configuration shown in FIG. 1, as the switch begins to open the arcing is transferred from the corona ball 12 of the blade 10 to the corona ring 28 of the first module. This introduces the first resistor module or body 20 into the circuit typically introducing a resistance of 500 ohms. As the switch continues to open, the arcing is transferred successively to the second, third and fourth corona rings 30, 32 and 34. This admits 500 ohms increments per phase into the circuit until the full resistance, in this case 2,000 ohms per phase, is inserted in the circuit.

Figure 2:
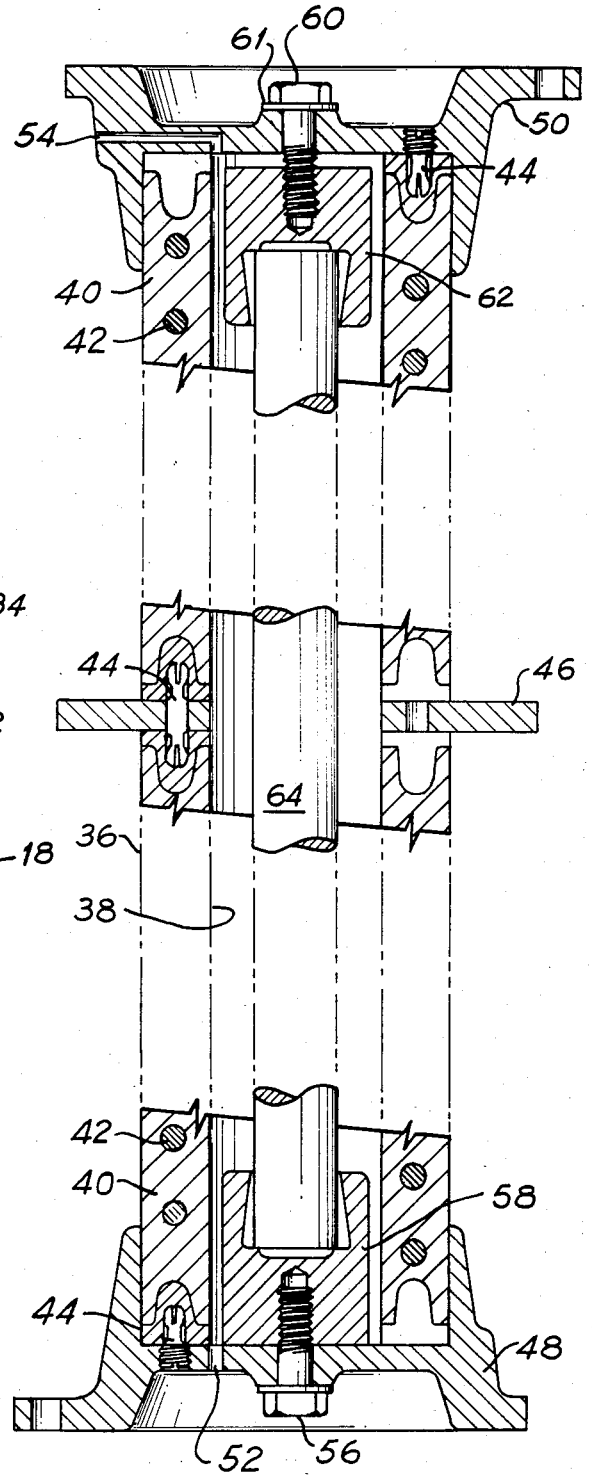
FIG. 2 is a longitudinal cross-section of a surge resistor structure which has a plurality of resistor bodies joined together in a unitary structure.

Referring now to FIG. 2, each resistor module contains a hollow, thermally conductive, electrically resistive body, which has an exterior surface 36 and an interior surface 38 for transferring heat from the body. The resistor body preferably has a cylindrical configuration and is preferably constructed of a highly thermally conductive epoxy material with electrically resistive material encapsulated therein so that heat generated by the passage of electrical current through the resistive material is conducted from the resistive material to the epoxy material.

In the preferred embodiment shown, the resistor body is composed of thermal epoxy material 40 which has electrically resistive nichrome wire 42 embedded therein so that the heat generated by the wire during operation is absorbed by the epoxy material. By this construction, the nichrome wire element is able to maintain a preselected temperature for the given duration of operation. Means, such as a contact stud 44, is preferably embedded in the end face of the resistor body in contact with the nichrome wire which is embedded therein in electrical contact therewith for forming an electrical connection to which circuit elements can be connected for conducting current through the resistor body.

A center flange 46 is positioned between adjacent resistor bodies, and along with the connecting means, provides a path for current flow from one resistor module to the adjacent resistor module and also provides a mounting means for a corona ring. The flange 46 preferably has a cylindrical opening aligned with the interior opening of the cylindrical resistor modules so that the inside of the surge resistor is hollow. By this construction, when the resistor is mounted vertically a chimney effect is created inside the resistor which increases air flow and improves cooling.

First and second end flanges 48, 50 are associated with each end of the resistor assembly. Each end flange is preferably configured to receive an end of a resistor body forming a cap structure on the end of the resistor body. The end flanges preferably have a plurality of openings 52, 54. When the resistor is assembled and mounted, the first end flange 48 is connected, preferably by bolts or other well-known means, to the mounting adapter 14 and the second end cap receives a corona ring 34. When vertically mounted, the interior of the resistor assembly is open and in communication with the atmosphere through the multiple openings 52, 54 in the end flanges and the communication with the atmosphere creates the chimney effect which helps remove heat from the interior surface of the resistor bodies. Thus, heat is conducted away from the nichrome wire resistive element 42 and the epoxy material 40 by the exterior and interior surfaces 36 and 38 and the end flanges 48 and 50. Where there is a center flange 46, it also conducts heat away from the resistor bodies.

The end flanges 48, 50 are provided with a bolt and rod end arrangement 56, 58 and 60, 62, respectively, which cooperate with the stacking rod 64. One or more washers 61, preferably spring washers, maintain compression of the resistor bodies under varying temperature conditions. The stacking rod 64 is constructed of a glass epoxy material and is positioned along the longitudinal axis inside the resistor bodies and extends between the rod ends 58 and 62. The stacking rod 64 is connected to the rod ends so that torquing the bolts creates a tensive force in the stacking rod 64. Sufficient compressive force is applied by tightening the bolts and the compressive force is exerted on the epoxy material of the resistor bodies. The force on the resistive bodies is sufficient to keep the bodies and adjacent flanges connected as a unitary structure. Therefore, the connecting rod 64 and the end flanges 48, 50 provide mechanical structural integrity for the resistor unit.

Operation of the resistor assembly is simple and straightforward. As current flows through the resistor, the nichrome wire is heated. The heat is absorbed by the thermal epoxy material which has been provided with interior and exterior surfaces and end faces as well as end portions which are in contact with end flanges. Heat is transferred from the exterior surface of the resistor body directly to the atmosphere. Heat is transferred from the epoxy material through the end faces to a flange via a center flange or an end flange. Finally heat is transferred from the interior surface of the epoxy material body and, by the chimney effect, is vented through the top of the resistor assembly. Because of the cooling effect provided by these various types of heat dissipation and distribution, test results for transformer switching duty at a 500 KV installation have verified that a 175 kilojoule rating is appropriate. This is in contrast to the prior surge resistor which only had a 50 kilojoule rating. This increased heat capacity is due to the extra cooling effect provided by the chimney effect, by the exterior surface of the epoxy material which is directly exposed to the atmosphere and by the heat which is transferred through the flanges.

It will now be understood that there has been disclosed an improved surge resistor for a disconnect switch which has mechanical integrity and improved cooling. The improved cooling is achieved by directly exposing the epoxy resistor body to the atmopshere so that its interior surface and its exterior surface are in communication the the atmosphere. The interior surface is in communication with the atmosphere and creates a chimney effect in the hollow resistor body construction so that extra cooling is achieved. The combined effect of these various methods of cooling is a surge resistor which has more than three times the thermal rating of the prior surge resistor.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A surge resistor, comprising:

at least first and second hollow, thermally conductive, electrically resistive bodies, each having an exterior surface and an interior surface for transferring heat from said body, said bodies being aligned along a common longitudinal axis;

a center flange positioned between the first and second resistor bodies;

a first end flange associated with the end of the first resistor body opposite the center flange;

a second end flange associated with the end of the second resistor body opposite the center flange; and an electrically insulative stacking rod positioned along the longitudinal axis inside the first and second resistor bodies and extending between the first and second end flanges and releasably connected thereto forming a unitary structure wherein the end flanges, center flange and resistor bodies are electrically connected.

2. A surge resistor, as set forth in claim 1, wherein the stacking rod is constructed of a glass epoxy material and the rod is stressed when connected to the end flanges in the unitary structure and the resistor bodies are maintained in compression for structural rigidity and electrical contact.

* * * * *